United States Patent [19]

Handleman

[11] Patent Number: 4,860,959

[45] Date of Patent: Aug. 29, 1989

[54] APPARATUS FOR SUBJECTING PARTICLES DISPERSED IN A FLUID TO A SHEARING ACTION

[75] Inventor: Avrom R. Handleman, Webster Groves, Mo.

[73] Assignee: Semi-Bulk Systems, Inc., Overland, Mich.

[21] Appl. No.: 211,552

[22] Filed: Jun. 23, 1988

[51] Int. Cl.[4] ..... B02C 19/00

[52] U.S. Cl. ..... 241/39; 137/891; 241/5; 241/300; 406/153

[58] Field of Search ..... 406/153; 137/891–894; 241/5, 39, 40, 100, 101 B, 245, 247

[56] References Cited

U.S. PATENT DOCUMENTS 3,436,030 4/1969 Stanton ..... 241/247 X 4,186,772 2/1980 Handleman ..... 241/5 X

*Primary Examiner*—Mark Rosenbaum

*Attorney, Agent, or Firm*—Senniger, Power, Leavitt & Roedel

[57] ABSTRACT

This invention relates to apparatus for subjecting particles dispersed in a fluid to a shearing action thereby to reduce the size of the particles. The apparatus comprises a body having a flow passage therethrough, and first and second nozzle members defining an annular orifice generally adjacent one end of the passage and generally coaxial therewith, the orifice having an axial dimension constituting its length (L) and a radial dimension constituting its width (W). The nozzle surfaces defining the orifice are generally parallel to one another and generally parallel to the axis of the one of the passage, which allows the length of the orifice to be adjusted, without changing the width of the orifice, by effecting axial movement of the second nozzle member relative to the first nozzle member. The width of the orifice may be adjusted by replacing either nozzle member with nozzle members of different configurations.

50 Claims, 5 Drawing Sheets

1
3
5
7
9
11
13
21
35
37
51
53
55
57
59
61
65
71
81
85
91
93
95
101
103
105
107
111
113
115
121
123
125
131
133
135
137
139

APPARATUS FOR SUBJECTING PARTICLES DISPERSED IN A FLUID TO A SHEARING ACTION

BACKGROUND OF THE INVENTION

This invention relates generally to systems for preparing and otherwise treating fluids having particulate matter dispersed therein (e.g., dispersions, slurries and emulsions) and, more specifically, to apparatus for reducing the size of particles (especially agglomerates of crystals and immiscible liquids) dispersed in a fluid by subjecting the particles to shearing action.

In applications where it is desirable to reduce the size of particles dispersed in a fluid, as in the preparation of ink, paint and liquid food products, for example, various sorts of equipment have been used, including mixing tanks with rotating "high shear" agitator blades. However, agitators consume large amounts of power and are relatively inefficient for reducing particles to very small size. Homogenizers of the type shown in U.S. Pat. No. 3,436,030 have been used in the dairy industry to homogenize milk, but the precise control and adjustment of shearing action on fluid passing through the equipment has been limited by the design of the orifices. The same holds true for the eductor-mixer in applicant's U.S. Pat. No. 4,186,772. It will be noted in this regard that the orifice geometry described in both of these patents does not permit independent adjustment of the length and width of the orifice through which the fluid is forced to effect shearing action.

SUMMARY OF THE INVENTION

Among the several objects of this invention may be noted the provision of improved apparatus adapted for subjecting particles dispersed in a fluid to shearing action to reduce the size of the particles to a desired size and to disperse the particles in the fluid; the provision of such apparatus which is readily adjustable more effectively to control the extent of shearing action on the particles, thereby allowing more precise control over the size of the particles resulting from the shearing action; the provision of such apparatus which has relatively few parts and which can be readily disassembled and assembled for cleaning and repairs; the provision of such apparatus in which certain parts subject to flow erosion may be readily and inexpensively replaced; the provision of such apparatus which is of relatively simple and durable construction, which is reliable in operation, and which requires no special training or skill for use; and the provision of apparatus of the type having nozzle components which are readily replaceable in the event of excessive wear.

In general, apparatus of this invention is used for subjecting particles dispersed in a fluid to a shearing action thereby to reduce the size of the particles. This apparatus comprises a body having a passage extending therethrough for flow of a pressurized fluid, a first nozzle member comprising a ring generally adjacent one end of the passage and generally coaxial with the one end of the passage, the ring having upstream and downstream faces and a central opening therethrough from its upstream to its downstream face. The ring has an inner peripheral surface forming a first nozzle surface extending from the upstream to the downstream face of the ring generally coaxial with said one end of the passage. The apparatus also includes a second nozzle member extending coaxially with respect to the passage into the central opening in the ring. The second nozzle member has an exterior surface forming a second nozzle surface generally coaxial with said one end of the passage. The said second nozzle surface is spaced radially inward from and surrounded by said first nozzle surface to form an annular orifice between the first and second nozzle surfaces through which pressurized fluid from the passage is adapted to pass with the particles in the fluid being subjected to shearing action as they are forced through the orifice thereby to reduce the size of the particles. The orifice has an axial dimension constituting its length and a radial dimension constituting its width. The first and second nozzle surfaces are generally parallel to one another and generally parallel to the axis of said one end of the passage. Means is provided for effecting movement of the second nozzle member axially of said one end of the passage to vary the relative axial positions of said first and second nozzle surfaces thereby to adjust the length of said orifice, without changing the width of the orifice, so as to vary the extent of shearing action on said particles. One of the nozzle members is formed separate from the body and is removably mounted in the passage whereby the width of the orifice may be adjusted to vary the severity of shearing action on said particles per unit length of orifice by removing the nozzle member from the passage and replacing it with another nozzle member having a nozzle surface configured to provide the desired orifice width.

A second aspect of this invention involves apparatus comprising a body having a passage therein for flow of a pressurized fluid therethrough, a first nozzle member comprising a replaceable ring formed separate from the body, and first mounting means for removably mounting said ring in a position generally adjacent one end of the passage and generally coaxial therewith, the ring having upstream and downstream faces and a central opening therethrough from its upstream to its downstream face. The ring further has an abrasion-resistant inner peripheral surface forming a first nozzle surface extending from the upstream to the downstream face of the ring. The apparatus also includes a second replaceable nozzle member formed separate from the body, and second mounting means for removably mounting the second nozzle member in a position extending generally coaxially with respect to the ring into the central opening in the ring. The second nozzle member has an abrasion-resistant exterior surface forming a second nozzle surface generally coaxial with the ring. The second nozzle surface is spaced radially inward from and surrounded by said first nozzle surface to form an annular orifice between the first and second nozzle surfaces through which pressurized fluid from the passage is adapted to pass with the particles in the fluid being subjected to shearing action as they are forced through the orifice thereby to reduce the size of the particles. The orifice has an axial dimension constituting its length and a radial dimension constituting its width. The second mounting means comprises an elongate support member extending generally coaxially with respect to said one end of the passage, and retainer means for releasably retaining said second nozzle member on said support member in a fixed axial position with respect to said support member. The first nozzle member is readily removable from the body and the second nozzle member is readily removable from the support member for replacment of the nozzle members in the event of excessive wear of said nozzle surfaces.

Other objects and features will be in part apparent and in part pointed out hereinafter.

BRIEF DESCRIPTION OF THE DRAWINGS

Corresponding reference numerals indicate corresponding parts throughout the several view of the drawings.

DESCRIPTION OF THE PREFERRED EMBODIMENT

Figures 1, 2:
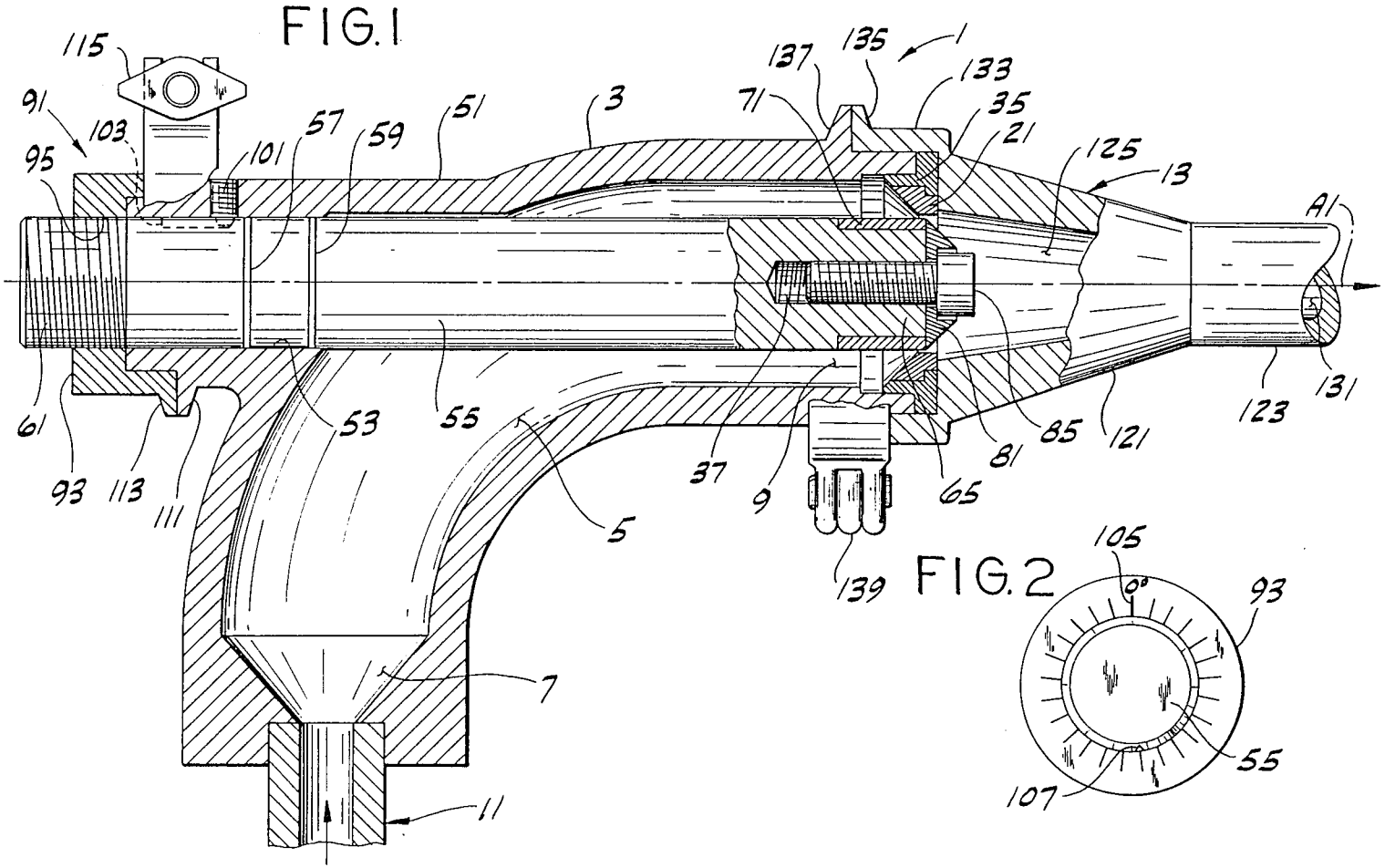
FIG. 1 is longitudinal cross-sectional view of apparatus of this invention.
FIG. 2 is a left end elevation of a portion of FIG. 1.

Referring now to the drawings, shear apparatus of this invention, indicated in its entirety at 1, is shown as comprising a body or housing 3 having a curved passage 5 therethrough for flow of pressurized fluid from one end of the passage, constituting its inlet end 7, to the other end of the passage, constituting its discharge end 9. The passage 5 is preferably of generally uniform circular cross-section throughout its length. The inlet end 7 of the body is adapted to be connected to a fluid delivery system, generally designated 11. The discharge end of the body is adapted to be connected to a receiving member generally indicated at 13 into which fluid having been subjected to shearing action is received and discharged. The body 3 of the system is preferably cast or fabricated of suitable metal, such as stainless steel. While body 3 is shown to be generally in the shape of a 90-degree elbow, it will be understood that it may assume other shapes without departing from the scope of this invention.

A first nozzle member in the form of a replaceable ring 21 is disposed within the body 3 generally adjacent one end of the passage 5 (its discharge end 9, as illustrated) and generally coaxial therewith. The ring 21 has upstream and downstream faces designated 23 and 25, respectively, and a central opening 27 therethrough from its upstream to its downstream face. The central opening 27 is defined by an inner peripheral surface of the ring which forms a first nozzle surface 31 extending from the upstream to the downstream face of the ring generally coaxial with the discharge end of the passage and generally parallel to the central longitudinal axis A1 of the discharge end 9 of the passage. In the embodiment shown in FIGS. 1–3, this nozzle surface 31 is cylindric and of substantially uniform diameter from the upstream face 23 of the ring to the downstream face 25 of the ring. The upstream face 23 of the ring is conical in shape and converges in downstream direction. The downstream face 25 of the ring is generally planar, lying in a plane extending generally at right angles with respect to axis A1.

Figure 3:
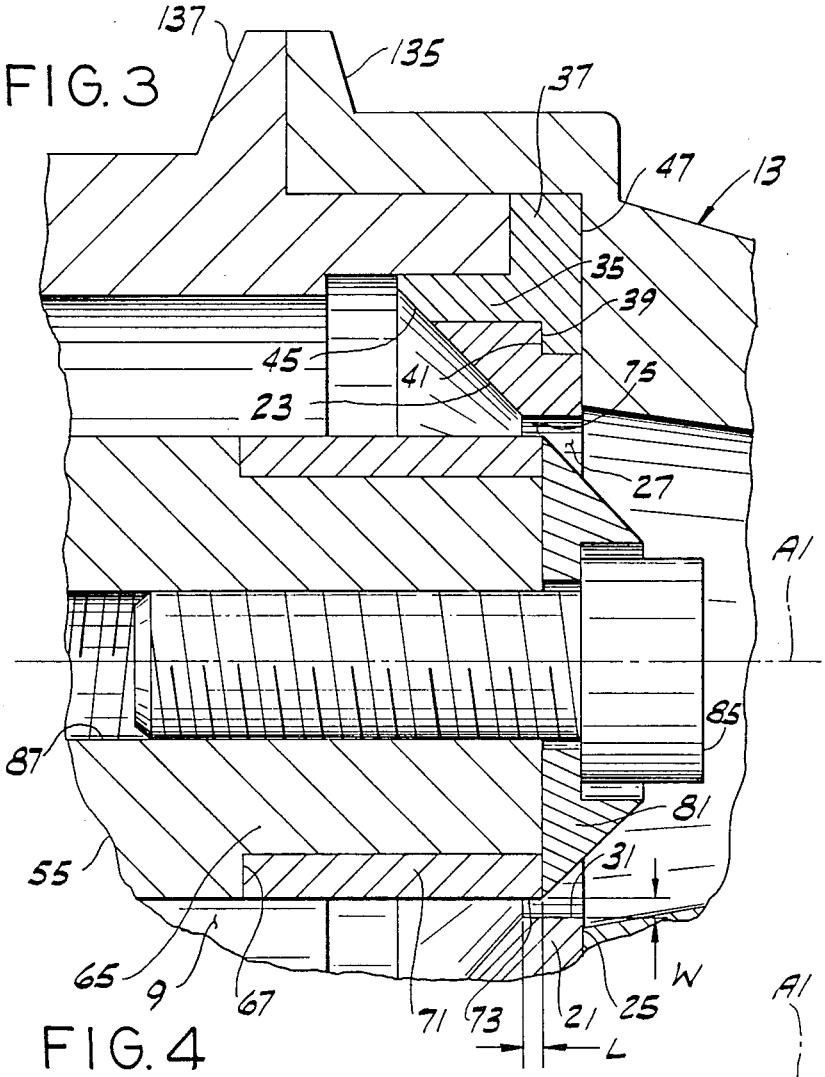
FIG. 3 is an enlarged portion of FIG. 1 showing details of the nozzle of the apparatus.

Means comprising an annular mounting member 35 is provided for removably mounting the ring 21 in fixed position coaxial with the discharge end 9 of the passage 5 through the body 3. The mounting member 35 is coaxial with the discharge end of the passage and has a radial flange 37 held between the receiving member 13 and the end of the body 3 at the discharge end 9 of the passage 5. As illustrated in FIGS. 1–3, the mounting member 35 is formed with an internal annular shoulder 39 engageable by an external annular shoulder 41 on the ring 21 to properly position the ring radially and axially with respect to the discharge end of the passage 5 in the body. The annular mounting member 35 has an upstream face 45 which is shown to be generally conical in shape and convergent in downstream direction, the result being that this face 45 and the upstream face 23 of the ring 21 form a continuous uninterrupted surface converging toward the discharge end of the passage. The downstream face 47 of the annular mounting member is generally coplanar with the downstream face 25 of the ring.

A tubular extension 51 formed as an integral part of the body 3 projects rearwardly from the body (to the left as shown in FIG. 1) at the bend of the elbow. The extension 51 has a bore 53 therethrough generally coaxial with the discharge end 9 of the passage 5. An elongate support member in the form of a rod 55 of circular section solid bar stock is slidably mounted in this bore 53 and extends into the passage 5 to a point where the downstream end of the rod is positioned in the discharge end 9 of the passage and coaxial with the passage. A pair of O-rings 57, 59 spaced at intervals along the rod 55 seal against the walls of the bore 53 to prevent leakage therepast. The left end of the rod projects rearwardly (to the left as viewed in FIG. 1) beyond the extension 51 and is threaded, as indicated at 61, for reasons which will become apparent.

The rod 55 has a cylindric end portion 65 of reduced diameter downstream from an external annular shoulder 67 on the rod lying in a radial plane of the rod. A second nozzle member comprising a replaceable sleeve 71 of wear-resistant material is removably mounted on the reduced-diameter end portion 65 of the rod within the central opening 27 in the ring 21. The sleeve 71 has an external surface forming a second nozzle surface 73 generally coaxial with the discharge end 9 of the passage 5. The second nozzle surface 73 is spaced radially inward from and surrounded by the inner surface 31 of the ring 21 to form an annular orifice 75 between the two surfaces through which pressurized fluid from the passage 5 is adapted to pass with the particles in the fluid being subjected to shearing action as they are forced through the orifice. This shearing action breaks up agglomerates and reduces the size of particles in the fluid. The orifice 75 has an axial dimension L constituting its length and a radial dimension W constituting its width. In accordance with this invention, the nozzle surfaces 31 and 73 are generally parallel to one another and generally parallel to the axis A1 of the discharge end 9 of the passage 5.

The sleeve 71 is releaseably retained in fixed position on the downstream end of the rod 55 between the external shoulder 67 on the rod, which is spaced upstream from the downstream end of the rod a distance substantially equal to the axial length of the sleeve, and a frustroconical retainer member 81 removably mounted on the downstream end of the rod. The retainer has an external surface convergent in downstream direction from an upstream face 83 which projects radially outwardly beyond the rod, the sleeve 71 thus being held captive between the shoulder 67 and the upstream face 83 of the retainer member 81.

The upstream face 83 of the retainer member has an outer diameter no greater then the outer diameter of the sleeve. The retainer member 81 is secured in position by means of a machine screw 85 threaded into an axial bore 87 in the rod.

It will be understood that the second (inner) nozzle member 71 of this invention may take forms other than a cylindric sleeve and that it may be retained in position by means other than the retainer member 81 shown in the drawings.

The ring 21 and sleeve 71 constituting the nozzle surfaces are preferably made of a special material (e.g., a hard metal sold under the trade designation "Stellite", other hardened metals, ceramics or other wear-resistant plastics or composites) which resists abrasion by particles in the fluid flowing at high speeds and under high pressures through the orifice 75. Alternatively, these surfaces may be hardened (e.g., carburized or nitrided) to provide good wear resistance.

Figure 4:
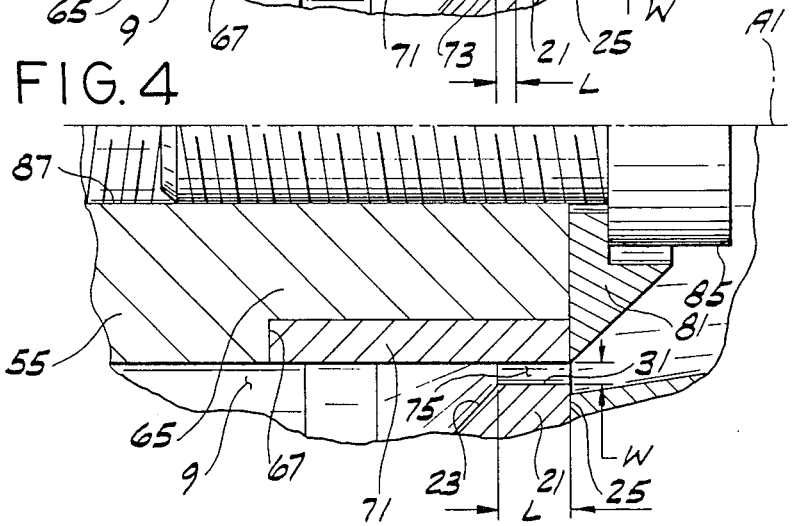
FIG. 4 is a view similar to FIG. 3 illustrating how the width and length of the nozzle orifice are adjustable.

In accordance with this invention, means indicated generally at 91 is provided for effecting sliding movement of the rod 55 axially in the bore 53 to vary the relative axial positions of the sleeve 71 and ring 21 and thereby adjust the length L of the orifice 75, without changing the width W of the orifice, to vary the extent of shearing action on the particles in fluid passing through the orifice. It will be understood in this regard that the greater the length L of the nozzle orifice 75, the greater the shearing action will be on the particles. For example, with the rod 55 adjusted to provide a relatively short orifice, as shown in FIG. 3, the extent of shearing action on particles passing through the orifice will be less than where the rod is adjusted to provide a longer orifice, as shown in FIG. 4.

Means 91 comprises a screw member in the form of a cap 93 rotatably mounted on the tubular extension 51 and having a central bore 95 therethrough for receiving the threaded end 61 of the rod. The bore 95 of the cap is provided with internal threads interengageable with the external threads on the rod, the arrangement being such that rotation of the screw cap effects axial movement of the rod 55 in the bore 53. A setscrew or pin 101 projecting radially into a groove 103 extending axially of the rod constitutes means for preventing rotation of the rod in the bore as the screw cap 93 is turned. The setscrew 101 is engageable with the ends of the groove 103 to limit axial travel of the rod in bore 95.

As best illustrated in FIG. 2, the face of the cap 93 has index markings 105 spaced at equal intervals therearound so that the cap may be turned to the appropriate position to obtain the desired length L of orifice 75. For example, the end 61 of the rod 55 may be formed with 20 threads per inch and the cap may have 25 equally spaced index markings therearound, so that turning the cap one index marking advances or retracts the rod (and thus the sleeve 71) a distance of 0.002 in. to change the orifice length L by the same amount. An axial groove 107 cut in the threads of the rod 55 serves as a reference line to indicate the angular position of the cap 93 relative to its "home" position in which it is in alignment with the "0" index marking corresponding to an orifice 75 of maximum length L. The rearward (left) end of the tubular extension 51 and the forward (right) end of the screw cap 93 are formed with radial flanges designated 111 and 113, respectively, which are clamped together in face to face relation by a suitable clamp 115. Once the cap 93 has been turned to obtain the desired orifice length L, this clamp 115 is adapted to be tightened to prevent relative rotation between the cap and the body 3 to ensure that the orifice length L remains unchanged until further adjustment.

The receiving member 13 comprises a transition section 121 immediately downstream from the body 3 and a discharge conduit 123 downstream from the transition section. The transition section 121 has a passage 125 therethrough which is generally coaxial with axis A1 and which converges in downstream direction. The inlet end of the passage through the transition section is slightly greater than the outer diameter of the orifice 75 to ensure a smooth uninterrupted flow through the orifice. The discharge conduit 123 has a constant-diameter passage 131 therethrough generally coaxial with the passage 125 through the transition section 121. The upstream end of the transition section is formed with a cylindric structure 133 which telescopes over the downstream end of the body 3. The cylindric structure 133 has a peripheral radial flange 135 at its upstream end which is held in sealing engagement with a radial flange 137 on the body by means of a suitable clamp 139, the latter of which may be removed to permit removal of the receiving member 13 from the body 3. The dimensions are such that when the clamp 139 is tightened in place, the radial flange 37 of the ring mounting member 35 is clamped tightly between the downstream face of the body and an internal face 141 of the receiving member.

As discussed, the length L of the orifice 75 may be adjusted by rotating screw cap 93 to move the rod 55 (and thus sleeve 71) axially of the discharge end 9 of the passage 5 through the body. This adjustment is independent of any change in the width W of the orifice. In other words, the length L of the orifice may be adjusted without changing the width W of the orifice 75. However, in accordance with this invention, the width W of the orifice may also be adjusted without changing the length L of the orifice. This may be accomplished by removing the ring 21 and replacing it with another ring having the desired inside diameter to provide an orifice 75 of selected width W so as to vary the severity of shearing action on particles passing through the orifice. It will be noted in this latter regard that the smaller the width W, the greater will be the shearing action per unit of orifice length. The orifice width W may also be varied by removing the sleeve 71 and replacing it with another sleeve or nozzle member having the desired outer diameter to provide an orifice of selected width.

Thus, in the apparatus of this invention, the length L and width W of the orifice 75 are independently adjustable to obtain the desired shearing action to break up agglomerates in the fluid and to reduce the size of particles flowing through the orifice. This independent adjustment feature provides greater flexibility to accommodate a greater range of shearing applications. For example, for some particularly viscous dispersions or dispersions of large particles, the orifice 75 may have to have a relatively large width W to enable flow through the orifice without excessive pressures. However, the necessary shearing action may still be effected by adjusting the length L of the orifice.

Figure 5:
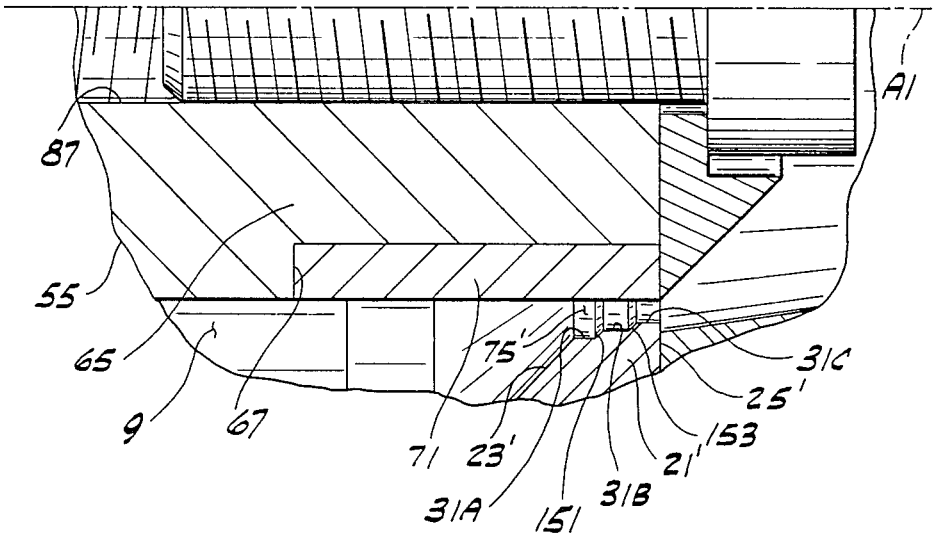
FIG. 5 is an alternative orifice design.

FIG. 5 illustrates another orifice design 75, wherein the ring 21' is stepped to provide a series of generally cylindric nozzle subsurfaces 31A, 31B and 31C of decreasingly smaller diameter from the upstream face 23' of the ring to the downstream face 25' of the ring. Each nozzle subsurface 31A, 31B and 31C is generally coaxial with the discharge end 9 of the passage 5 and also generally parallel to the axis A1 of the passage. The shoulders 151, 153 separating the subsurfaces 31A, 31B and 31C are preferably convergent in downstream direction at an angle of from about 35–45 degrees relative to the axis A1 of the passage. This design is preferable for applications where it is desired to subject particles in the fluid to progressively greater shearing action as their size is reduced in successive sections of the orifice 75'. Other orifice configurations may also be suitable.

Figure 6:
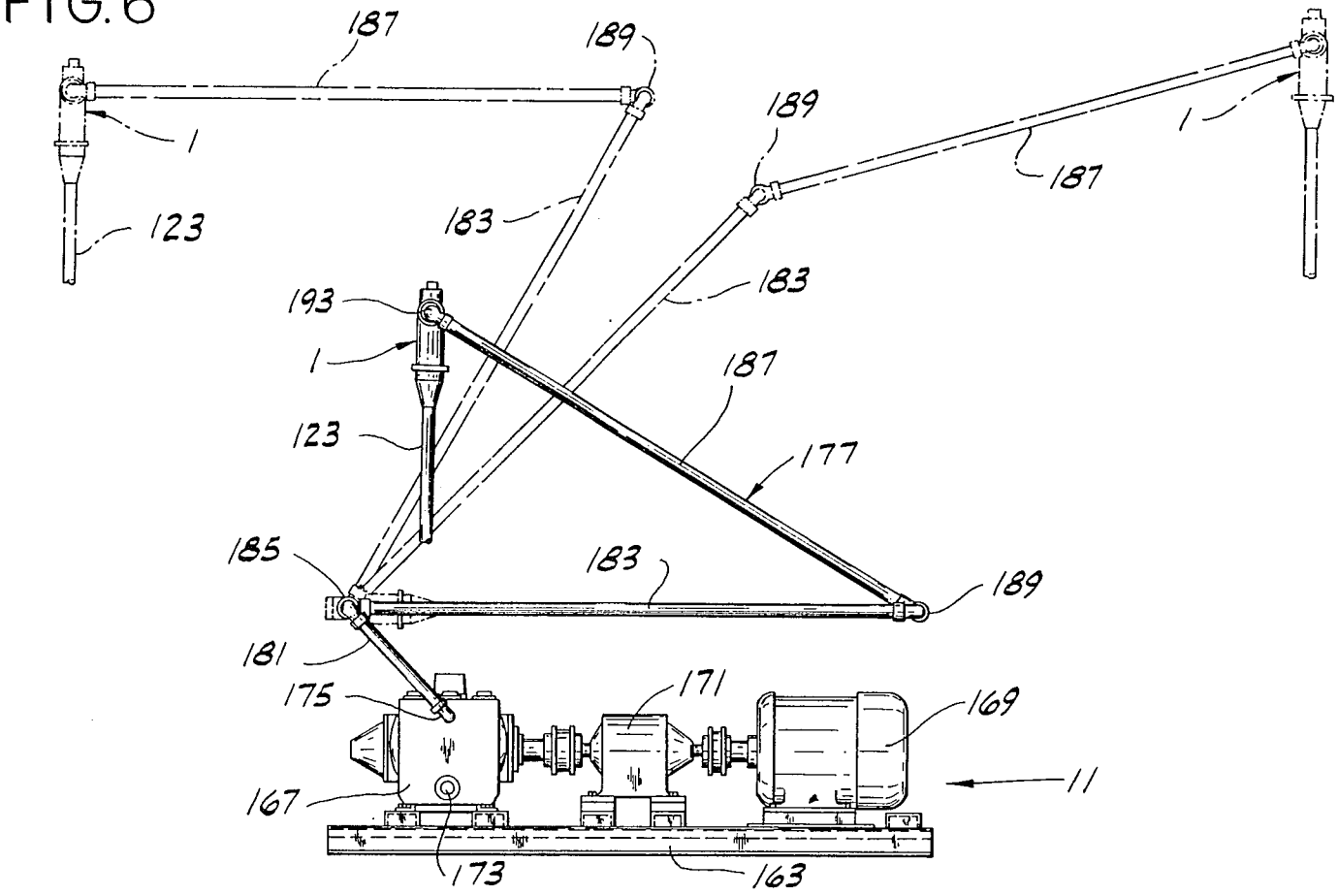
FIG. 6 is a side elevational view of system for delivery of pressurized fluid having particles dispersed therein to the shearing nozzle.
Figure 7:
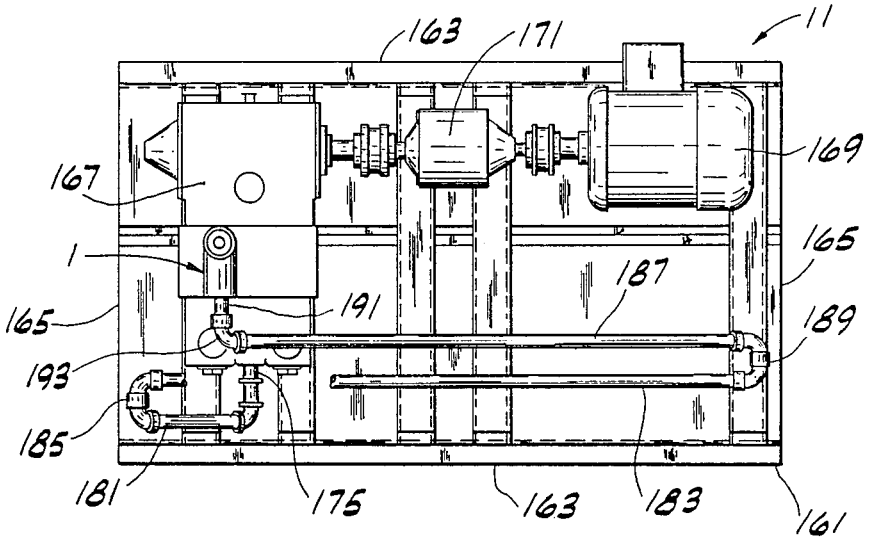
FIG. 7 is a top plan view of FIG. 6.
Figure 8:
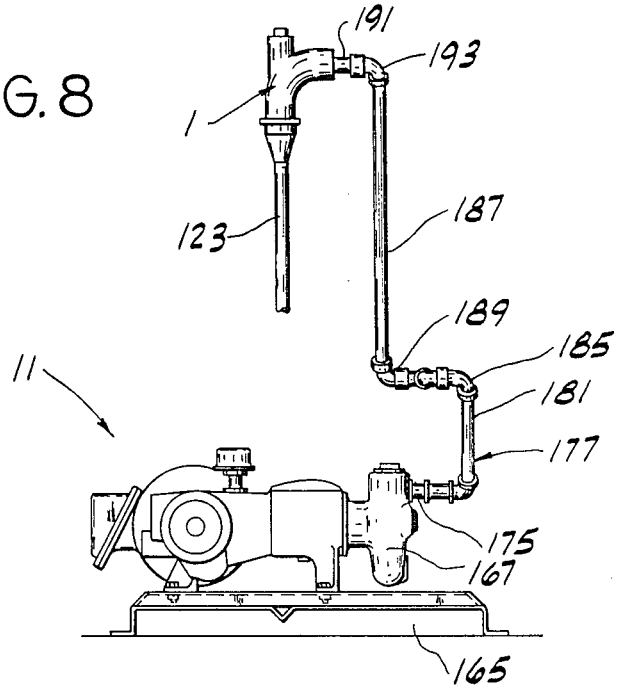
FIG. 8 is an end elevational view of FIG. 6.

As illustrated in FIGS. 6–8, the preferred fluid delivery system 11 comprises a base 161 having opposite sides 163 and opposite ends 165, a high pressure pump 167 driven by a motor 169 coupled to the pump by a speed reducer 171. The pump 167 has an intake 173 and a discharge 175. The system also includes an adjustable conduit generally designated 177 having an inlet end connected to the discharge 175 of the pump and an outlet end connected to the inlet end 7 of the passage 5 through the body or housing 3 of the shear apparatus. More specifically, the adjustable conduit 177 comprises a stationary, relatively short first section 181 connected to the discharge 175 of the pump 167, a second relatively long section 183 connected by means of universal joint 185 to the first section 181 to permit swinging movement of the second section in a generally vertical plane about an axis extending in side-to-side direction with respect to the base, a third relatively long section 187 connected by means of universal joint 189 to the second section 183 to permit swinging movement of the third section 187 relative to the second section in a generally vertical plane about an axis extending in side-to-side direction with respect to the base, and fourth relatively short section 191 interconnecting the third section 187 and the inlet end 7 of the passage 5 through the body 3. A universal joint 193 between the third and fourth sections 187, 191 enables swinging movement of the body 3 and the receiving member 13, including the discharge conduit 123, relative to the third section 187 in a generally vertical plane about an axis extending in side-to-side direction with respect to the base 165. Thus, by articulating the various sections of the adjustable conduit 177, the elevation of the discharge tube 123 and its position endwise relative to the base may be varied depending on need. It will be understood that other configurations of adjustable conduit 177 may be possible, including configurations where the body 3 may be adjusted in side-to-side direction with respect to the base 165.

As mentioned, the pump 167 is a high-pressure pump (e.g., a piston pump), preferably being capable of delivering fluid to the body 3 of the shear apparatus at pressures ranging from about 500 psi to about 5000 psi and at flow rates ranging from about 3 gal/min to about 100 gal/min or more. The higher flow rates are generally suited for industrial applications, whereas the lower flow rates are more suited for non-industrial applications, such as in laboratories. The adjustable conduit 177 is fabricated from high-pressure tubing, such as carbon or stainless steel tubing or pipe.

It will be observed from the foregoing that the shear system of the present invention is readily adjustable to vary the degree or severity of shearing action on agglomerates and individual particles passing through the nozzle orifice 75 of the system. This is accomplished by adjusting the length L of the orifice (by turning cap 93 to the desired angular position) and/or by adjusting the width W of the orifice (by using a ring 21 with the appropriate inside diameter). Moreover, the nozzle surfaces (sleeve 71 and ring 21) are readily replaceable in the event of excessive wear. The system is also capable of quick disassembly for efficient cleaning.

It will be noted that the feature of this invention involving the replaceable nozzle members (e.g., ring 21 and sleeve 71) may be used in apparatus having a primary purpose other than subjecting particles in a fluid to a shearing action. For example, this feature may also incorporated in the eductor-mixer system of U.S. Pat. No. 4,186,772.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for subjecting particles dispersed in a fluid to a shearing action thereby to reduce the size of the particles, comprising:

a body having a passage therein for flow of a pressurized fluid therethrough, a first nozzle member comprising a ring generally adjacent one end of the passage and generally coaxial with said one end of the passage, said ring having upstream and downstream faces and a central opening therethrough from its upstream to its downstream face, said ring having an inner peripheral surface forming a first nozzle surface extending from the upstream to the downstream face of the ring generally coaxial with said one end of the passage;

a second nozzle member extending generally coaxially with respect to said one end of the passage into the central opening in the ring, said second nozzle member having an exterior surface forming a second nozzle surface generally coaxial with said ring, said second nozzle surface being spaced radially inward from and surrounded by said first nozzle surface to form an annular orifice between the first and second nozzle surfaces through which pressurized fluid from the passage is adapted to pass with the particles in the fluid being subjected to shearing action as they are forced through the orifice thereby to reduce the size of the particles, said orifice having an axial dimension constituting its length and a radial dimension constituting its width, said first and second nozzle surfaces being generally parallel to one another and generally parallel to the axis of said one end of the passage; and means for effecting movement of the second nozzle member axially of said one end of the passage to vary the relative axial positions of said first and second nozzle surfaces thereby to adjust the length of said orifice, without changing the width of the orifice, so as to vary the extent of shearing action on said particles;

one of said nozzle members being formed separate from said body and being removably mounted in said passage whereby the width of the orifice may be adjusted to vary the severity of shearing action on said particles per unit length of orifice by removing said one nozzle member from said passage and replacing it with another nozzle member having a nozzle surface configured to provide the desired orifice width.

2. Apparatus as set forth in claim 1 wherein said first nozzle surface is of substantially uniform diameter from the upstream face of the ring to the downstream face of the ring.

3. Apparatus as set forth in claim 1 wherein said second nozzle surface is of substantially uniform diameter throughout the length of the orifice.

4. Apparatus as set forth in claim 1 wherein said orifice is of substantially constant cross section throughout its length throughout the range of axial adjustment of the second nozzle member.

5. Apparatus as set forth in claim 1 wherein said first nozzle surface is stepped to provide a series of generally cylindric nozzle subsurfaces of decreasingly smaller diameter from the upstream face of the ring to the downstream face of the ring, each nozzle subsurface being generally coaxial with said one end of said passage and generally parallel to the central longitudinal axis of the said one end of the passage.

6. Apparatus as set forth in claim 1 wherein said second nozzle member comprises a replaceable sleeve of wear-resistant material removably mounted on an elongate support member of generally circular section extending in said passage generally coaxially with said one end of the passage, said apparatus further comprising retainer means for retaining said sleeve in fixed axial position on said support member.

7. Apparatus as set forth in claim 6 wherein said support member is axially slidable in a bore in said body generally coaxial with said one end of said passage, and wherein said means for effecting movement of the second nozzle member axially of the passage comprises means for effecting sliding axial movement of the support member in the bore.

8. Apparatus as set forth in claim 7 wherein said means for effecting sliding axial movement of the support member in said bore comprises a screw member rotatably mounted on said body and having a threaded fit with the support member whereby rotation of the screw member on the body effects axial movement of the support member in the bore.

9. Apparatus as set forth in claim 8 further comprising means for preventing rotation of the support member in said bore as the screw member is rotated.

10. Apparatus as set forth in claim 6 wherein said support member has an external annular shoulder spaced upstream from the downstream end of the support member a distance substantially corresponding to the axial length of said sleeve, said retainer means comprising a retainer member removably mounted on the downstream end of the support member having an upstream face projecting radially outwardly beyond the support member, said sleeve being held captive between said shoulder and said upstream face of the retainer member.

11. Apparatus as set forth in claim 10 wherein said retainer member has an exterior surface convergent in downstream direction.

12. Apparatus as set forth in claim 10 wherein said shoulder is disposed in a generally radial plane of the support member and the support member has a cylindric end portion of reduced diameter downstream from said shoulder.

13. Apparatus as set forth in claim 6 wherein said retainer means has an exterior surface convergent in the downstream direction.

14. Apparatus as set forth in claim 1 wherein the upstream face of said ring converges in downstream direction.

15. Apparatus as set forth in claim 1 wherein said ring is of wear-resistant material and said apparatus further comprising means for removably mounting said ring in fixed position in said one end of said passage.

16. Apparatus as set forth in claim 15 further comprising a receiving member downstream from said body having a passage therethrough generally coaxial with said one end of the passage through the body, and means for removably securing the receiving member to the body, said means for removably mounting the ring comprising an annular mounting member coaxial with said one end of the passage having a radial flange held between said receiving member and the end of the body at said one end of the passage, said mounting member having an internal annular shoulder engageable by an annular external shoulder on said ring to position the ring radially and axially with respect to said one end of the passage in the body.

17. Apparatus as set forth in claim 16 wherein said annular mounting member has an upstream face which combines with the upstream face of said ring to form a continuous surface convergent in downstream direction.

18. Apparatus as set forth in claim 1 further comprising a pump adapted to be mounted on a base, said pump having an intake and an discharge, a conduit having an inlet end adapted for connection to the discharge of the pump and an outlet end, a universal joint adapted for connecting the outlet end of the conduit and said passage through said body, said conduit being adjustable to vary the elevation of its outlet end and the elevation of said body above said base, and said universal joint enabling adjustment of the orientation of said body.

19. Apparatus as set forth in claim 18 wherein said base has opposite sides and opposite ends, said conduit comprising at least three conduit sections connected end to end by joints permitting relative pivotal movement of the sections in a generally vertical plane about axes extending in side-to-side direction with respect to the base whereby the position of said body may be adjusted both vertically and endwise with respect to the base.

20. Apparatus as set forth in claim 18 wherein said pump is a high-pressure pump adapted for delivery of fluid to said body at pressures ranging from about 500 psi to about 5000 psi or more and at flow rates ranging from about 1 gal/min to about 100 gal/min.

21. Apparatus for subjecting particles dispersed in a fluid to a shearing action thereby to reduce the size of the particles, comprising:

a body having a passage therein for flow of a pressurized fluid therethrough;

a first nozzle member comprising a replaceable ring formed separate from the body;

first mounting means for removably mounting said ring in a position generally adjacent one end of the passage and generally coaxial therewith, said ring having upstream and downstream faces and a central opening therethrough from its upstream to its downstream face, said ring further having an abrasion-resistant inner peripheral surface forming a first nozzle surface extending from the upstream to the downstream face of the ring;

a second replaceable nozzle member formed separate from the body; and second mounting means for removably mounting said second nozzle member in a position extending generally coaxially with respect to the ring into the central opening in the ring, said second nozzle member having an abrasion-resistant exterior surface forming a second nozzle surface generally coaxial with the ring, said second nozzle surface being spaced radially inward from and surrounded by said first nozzle surface to form an annular orifice between the first and second nozzle surfaces through which pressurized fluid from the passage is adapted to pass with the particles in the fluid being subjected to shearing action as they are forced through the orifice thereby to reduce the size of the particles, said orifice having an axial dimension constituting its length and a radial dimension constituting its width;

said second mounting means comprising an elongate support member extending generally coaxially with respect to said one end of the passage, and retainer means for releasably retaining said second nozzle member on said support member in a fixed axial position with respect to said support member;

said first nozzle member being readily removable from the body and said second nozzle member being readily removable from said support member for replacment of the nozzle members in the event of excessive wear of said nozzle surfaces.

22. Apparatus as set forth in claim 21 wherein said first nozzle surface is of substantially uniform diameter from the upstream face of the ring to the downstream face of the ring.

23. Apparatus as set forth in claim 21 wherein said second nozzle surface is of substantially uniform diameter throughout the length of the orifice.

24. Apparatus as set forth in claim 21 wherein said orifice is of substantially constant cross section throughout its length.

25. Apparatus as set forth in claim 21 wherein said first mounting means comprises an annular mounting member generally coaxial with said one end of the passage and having a radial flange held against the body at said one end of the passage, said mounting member having an internal annular shoulder engageable by an annular external shoulder on said ring to position the ring radially and axially with respect to said one end of the passage in the body.

26. Apparatus as set forth in claim 21 wherein said second nozzle member comprises a replaceable sleeve of wear-resistant material mounted on said support member.

27. Apparatus as set forth in claim 26 wherein said support member has an external shoulder spaced upstream from the downstream end of the support member a distance substantially corresponding to the axial length of said sleeve, said retainer means comprising a retainer member removably mounted on the downstream end of the support member having an upstream face projecting radially outwardly beyond the support member, said sleeve being held captive between said shoulder and said upstream face of the retainer member.

28. Apparatus as set forth in claim 27 wherein said retainer member has an exterior surface convergent in downstream direction.

29. Apparatus as set forth in claim 27 wherein said shoulder is disposed in a generally radial plane of the support member and the support member has a cylindric end portion of reduced diameter downstream from said shoulder, said sleeve having an outer diameter no greater than the outer diameter of the support member upstream from the shoulder.

30. Apparatus as set forth in claim 26 wherein said retainer means has an exterior surface convergent in the downstream direction.

31. Apparatus as set forth in claim 21 wherein said first and second nozzle surfaces are generally parallel to one another and generally parallel to the axis of said one end of the passage.

32. Apparatus as set forth in claim 31 further comprising means for effecting movement of the second nozzle member axially of said one end of the passage to vary the relative axial positions of said first and second nozzle surfaces thereby to adjust the length of said orifice, without changing the width of the orifice, so as to vary the extent of shearing action on said particles.

33. Apparatus as set forth in claim 32 wherein said support member is slidably mounted in a bore in the body for movement generally along the axis of said ring, said means for effecting movement of the second nozzle member axially of the passage comprising means for effecting sliding axial movement of the support member in the bore.

34. Apparatus as set forth in claim 33 wherein said means for effecting sliding axial movement of the support member in said bore comprises a screw member rotatably mounted on said body and having a threaded fit with the support member whereby rotation of the screw member on the body effects axial movement of the support member in the bore.

35. Apparatus as set forth in claim 34 further comprising means for preventing rotation of the support member in said bore as the screw member is rotated.

36. Apparatus with removable nozzle members, comprising:

a body having a passage therein for flow of a pressurized fluid therethrough;

a first nozzle member comprising a replaceable ring formed separate from the body;

first mounting means for removably mounting said ring in a position generally adjacent one end of the passage and generally coaxial therewith, said ring having upstream and downstream faces and a central opening therethrough from its upstream to its downstream face, said ring further having an abrasion-resistant inner peripheral surface forming a first nozzle surface extending from the upstream to the downstream face of the ring;

a second replaceable nozzle member formed separate from the body; and second mounting means for removably mounting said second nozzle member in a position extending generally coaxially with respect to the ring into the central opening in the ring, said second nozzle member having an abrasion-resistant exterior surface forming a second nozzle surface generally coaxial with the ring, said second nozzle surface being spaced radially inward from and surrounded by said first nozzle surface to form an annular orifice between the first and second nozzle surfaces through which pressurized fluid from the passage is adapted to pass;

said second mounting means comprising an elongate support member extending generally coaxially with respect to said one end of the passage, and retainer means for releasably retaining said second nozzle member on said support member in a fixed axial position with respect to said support member;

said first nozzle member being readily removable from the body and said second nozzle member being readily removable from said support member for replacment of the nozzle members in the event of excessive wear of said nozzle surfaces.

37. Apparatus as set forth in claim 36 wherein said first nozzle surface is of substantially uniform diameter from the upstream face of the ring to the downstream face of the ring.

38. Apparatus as set forth in claim 36 wherein said second nozzle surface is of substantially uniform diameter throughout the length of the orifice.

39. Apparatus as set forth in claim 36 wherein said orifice is of substantially constant cross section throughout its length.

40. Apparatus as set forth in claim 36 wherein said means for removably mounting said ring comprises an annular mounting member generally coaxial with said one end of the passage and having a radial flange held against the body at said one end of the passage, said mounting member having an internal annular shoulder engageable by an annular external shoulder on said ring to position the ring radially and axially with respect to said one end of the passage in the body.

41. Apparatus as set forth in claim 36 wherein said second nozzle member comprises a replaceable sleeve of wear-resistant material mounted on said support member.

42. Apparatus as set forth in claim 41 wherein said support member has an external shoulder spaced upstream from the downstream end of the support member a distance substantially corresponding to the axial length of said sleeve, said retainer means comprising a retainer member removably mounted on the downstream end of the support member having an upstream face projecting radially outwardly beyond the support member, said sleeve being held captive between said shoulder and said upstream face of the retainer member.

43. Apparatus as set forth in claim 42 wherein said retainer member has an exterior surface convergent in downstream direction.

44. Apparatus as set forth in claim 42 wherein said shoulder is disposed in a generally radial plane of the support member and the support member has a cylindric end portion of reduced diameter downstream from said shoulder.

45. Apparatus as set forth in claim 44 wherein said retainer means has an exterior surface convergent in the downstream direction.

46. Apparatus as set forth in claim 36 wherein said first and second nozzle surfaces are generally parallel to one another and generally parallel to the axis of said one end of the passage, said orifice having an axial dimension constituting its length and a radial dimension constituting its width.

47. Apparatus as set forth in claim 46 further comprising means for effecting movement of the second nozzle member axially of said one end of the passage to vary the relative axial positions of said first and second nozzle surfaces thereby to adjust the length of said orifice, without changing the width of the orifice.

48. Apparatus as set forth in claim 47 wherein said support member is mounted in a bore in the body for sliding axial movement of the support member generally along the axis of said one end of the passage, said means for effecting movement of the second nozzle member axially of the passage comprising means for effecting sliding axial movement of the support member in the bore.

49. Apparatus as set forth in claim 48 wherein said means for effecting sliding axial movement of the support member in said bore comprises a screw member rotatably mounted on said body and having a threaded fit with the support member whereby rotation of the screw member on the body effects axial movement of the support member in the bore.

50. Apparatus as set forth in claim 49 further comprising means for preventing rotation of the support member in said bore as the screw member is rotated.

* * * * *